US006178586B1

(12) United States Patent
Jafarmadar

(10) Patent No.: US 6,178,586 B1
(45) Date of Patent: Jan. 30, 2001

(54) COMBINATION TROWEL

(76) Inventor: Hossein Jafarmadar, 75 Gulfstream Rd., Dania, FL (US) 33004

( * ) Notice: Under 35 U.S.C. 154(b), the term of this patent shall be extended for 0 days.

(21) Appl. No.: 09/288,004

(22) Filed: Apr. 8, 1999

(51) Int. Cl.[7] ..... B05C 17/10
(52) U.S. Cl. ..... 15/235.6; 15/235.4
(58) Field of Search ..... 15/235.4, 235.6, 15/235.8

(56) References Cited

U.S. PATENT DOCUMENTS

| | | | | |
|---|---|---|---|---|
| 3,166,776 | * | 1/1965 | Selck | 15/235.6 |
| 4,724,572 | * | 2/1988 | Gringer | 15/235.4 |
| 4,737,097 | * | 4/1988 | Cotugno | 15/235.4 |
| 4,766,635 | * | 8/1988 | DeVitis | 15/235.4 |
| 5,046,387 | * | 9/1991 | Levake | 15/235.4 |
| 5,231,729 | * | 8/1993 | Rose | 15/235.8 |
| 5,479,675 | * | 1/1996 | Pytlewski | 15/235.4 |

* cited by examiner

*Primary Examiner*—Terrence R. Till
(74) *Attorney, Agent, or Firm*—Malin, Haley & DiMaggio, P.A.

(57) ABSTRACT

A hand-held trowel that includes a first and second adjoining edges that have a plurality of notches disposed therein that is used to provide grooves in cementious material, said trowel used for spreading cementious material and said trowel including a third edge extending away from the trowel body having sufficient rigidity and strength for prying up a ceramic tile for use as a margin trowel. The trowel also includes a handle for grasping by hand that is rigidly attached to the trowel body which may include a level indicating device to tell with an air bubble and liquid whether or not the fourth edge of the trowel, which is straight when placed on the surface of a tile, is level relative to the gravitational field of the earth. A trowel for use with tile, brick, block and plaster may also include first and second level indicators mounted in the handle or on the trowel blade that provides for levels of indication or straightness relative to the earth's surface in two different planes.

3 Claims, 6 Drawing Sheets

COMBINATION TROWEL

BACKGROUND OF THE INVENTION

1. Field of the Invention

This invention relates to trowels for use in the laying of ceramic tiles doing masonry and plastering work which allow the user to apply the cementious material that allows attachment of the tile or other materials to a floor or wall surface through the manipulation of a hand-actuated tool called a trowel. Specifically, the invention relates to providing a single trowel that not only allows the user to manually apply and space the cementious material through the application of plurality of grooves but also provides for the use of the trowel as a lever for moving and rearranging a ceramic tile piece (once in place) through manual manipulation. The trowel also include a level indicator, built in the handle of the trowel to aid in the laying of ceramic tile, brick, block and plastering.

2. Description of Related Art

The use of hand trowels for applying and distributing cementious material that allows ceramic tile to be attached to a floor or wall surface is well-known. Typically, such a trowel is a thin rigid metal blade having a plurality of notches about one or two edges which are used to provide grooves or spacing in the cementious material before the adhesive material hardens or sets up which allows for better attachment of a ceramic piece of tile to a floor or wall by having rows of spaces or groove-like spaces in the cementious material that spreads when the tile is pressed against the cementious adhesive material.

Margin trowels are used that are hand-held rigid, thin flat surfaces that allow the user to pry up a piece of ceramic tile that has been misplaced or misaligned so that the tile can be rearranged or repositioned. Typically, the thin edge is slid under the tile into the cementious material and the entire ceramic tile is pried upwardly.

Conventionally today, most tile setters employ a plurality of trowels, one for applying cementious material in grooves and a second margin trowel for use in rearranging or pulling up tile that has been laid.

Another problem facing a tile setter is making sure that the ceramic tile is level. This requires the use of a separate level that once the tile has been installed, the level is placed on the tile to see how level the tile is. The margin trowel is also used for prying up ceramic tile and allowing more cementious material to be applied in order to level the tile.

Thus, in today's ceramic tile setting, the tile setter would have a first trowel for applying cementious material and making grooves in the cementious adhesive, a second trowel (called a "margin" trowel) for prying and lifting a ceramic tile and a separate level in order to ensure that the ceramic tile, once in place, is level.

The present invention eliminates the multiplicity of the above tools by providing a single trowel that can be used both for applying cementious material and grooving and also be used as a margin trowel for lifting while at the same time providing a built-in level in the trowel.

BRIEF SUMMARY OF THE INVENTION

A hand-held trowel for use in laying and setting ceramic tile to a floor or wall surface comprising a thin, rigid flat blade-shaped body (called a "blade") having at least three peripheral edges, at least one of said edges having a plurality of spaced-apart notches; a second edge having an extended protruding portion substantially rectangular, and a handle for grasping manually said trowel, said handle including a support member rigidly affixed (welded or screwed) to said rigid flat blade above said blade top surface on one side thereby forming a trowel.

The blade includes at least one notched edge along at least one side (and preferably two sides) of said blade. The notched pattern may be triangles spaced apart in a uniform pattern along the one or two blade edges length and width. The height of each triangle would be approximately at least a quarter of an inch but sized based on the depth of the cementious adhesive material rows or grooves desired or the pattern can be square or rectangles (much like a saw tooth pattern) with the depth of each saw tooth being dependent on the depth of the grooves desired.

In the preferred embodiment, at least two edges of a rectangularly shaped flat blade has a saw tooth pattern, the right side edge (length), and the top edge (the width). The bottom blade edge extends beyond the handle and may include one or more reinforcing bars for blade body strength to increase the amount of manual leverage available when prying up a tile without bending the blade. The bottom edge is rectangular and slightly smaller than the width of the middle blade body portion and includes a prying edge that can be used in conjunction with the handle of the trowel as a margin trowel.

In an alternate embodiment, rigid vertical support members could be connected between the upper surface of the blade body and the handle support for additional blade body strength especially for use as a margin trowel end prying edge. The handle support can be substantially L-shaped and welded to the top of the blade.

In the preferred embodiment, the trowel is made of a thin metal blade and is rectangularly shaped. The top edge (width) and the long side edge (length) includes a series of notches, symmetrically spaced apart, along the top and side edges. The left elongated edge (length) is straight, and does not have notches.

The bottom edge is extended and slightly narrower in width than the width of the entire trowel body and extends at least 1½ inches beyond the end of the trowel and is formed as part of the trowel blade to act as a margin trowel edge.

A cylindrical wooden or plastic handle may have a level indicator (relative to the earth) embedded in one or two areas. The level indicator is conventional and includes a tube housing a liquid and an air bubble that act as a level indicator with markings on the tube to show when the bubble is centered, indicating level. The level tube is mounted such that when the left straight blade edge (along the length viewed from the top) is laid flush against a tile upper surface, the level indicator in the handle can be observed by the user and the bubble can be observed between the marker lines to show whether or not the single piece of tile is level. This can be done in all directions on top of the tile.

When an in alternate embodiment, two different level indicators are used, the alignment of the level indicating gages is such that when placed in the handle of the trowel, one level is essentially parallel or in the plane of the trowel blade which means that when the edge of the trowel along the longitudinal edge is placed on top of a tile, then the level indicator positioned longitudinally in the cylindrical handle is in effect parallel to the earth or approximately parallel to the earth to give indications of whether or not the longitudinal edge of the trowel is level that is flush against a tile surface. The second level indicating device is a essentially at a 90° angle and rotated such that when the trowel is sitting flush on the blade, then the indicator is disposed laterally as a chord and is perpendicular to the longitudinal, cylindrical axis of the cylinder handle. The second level indicator is thus observable from above with the blade sitting flush. When the blade is moved to a vertical position, the second level indicator will be horizontal and thus parallel to the earth. The vertical position of the blade means that the longitudinal axis of the trowel blade is disposed vertical, essentially perpendicular to the earth's surface. Thus, with a single trowel, two separate and independent level measurements can be made—the first being whether or not a piece of ceramic tile on the floor is level relative to the earth and the second being whether or not ceramic tile on a wall surface is itself straight up and down relative to the earth's surface.

It is an object of this invention to provide improved trowel that can be used for laying cementious adhesive material used in laying ceramic tile, and can also be used as a margin trowel for lifting or prying up pieces of ceramic tile that need to be realigned or need to be leveled.

It is another object of this invention to provide a hand-held manual trowel for use in laying or setting ceramic tile that includes a level indicator that allows for individual measurement of each piece of tile to see whether it is level.

And yet still another object of this invention is to provide a trowel having first and second level indicating components disposed essentially perpendicular to each other for different planes so that the trowel itself can be used to measure whether tile is level and whether or not wall tile is vertically straight.

In accordance with these and other objects which will become apparent hereinafter, the instant invention will now be described with particular reference to the accompanying drawings.

DETAILED DESCRIPTION OF THE INVENTION

Figure 1:
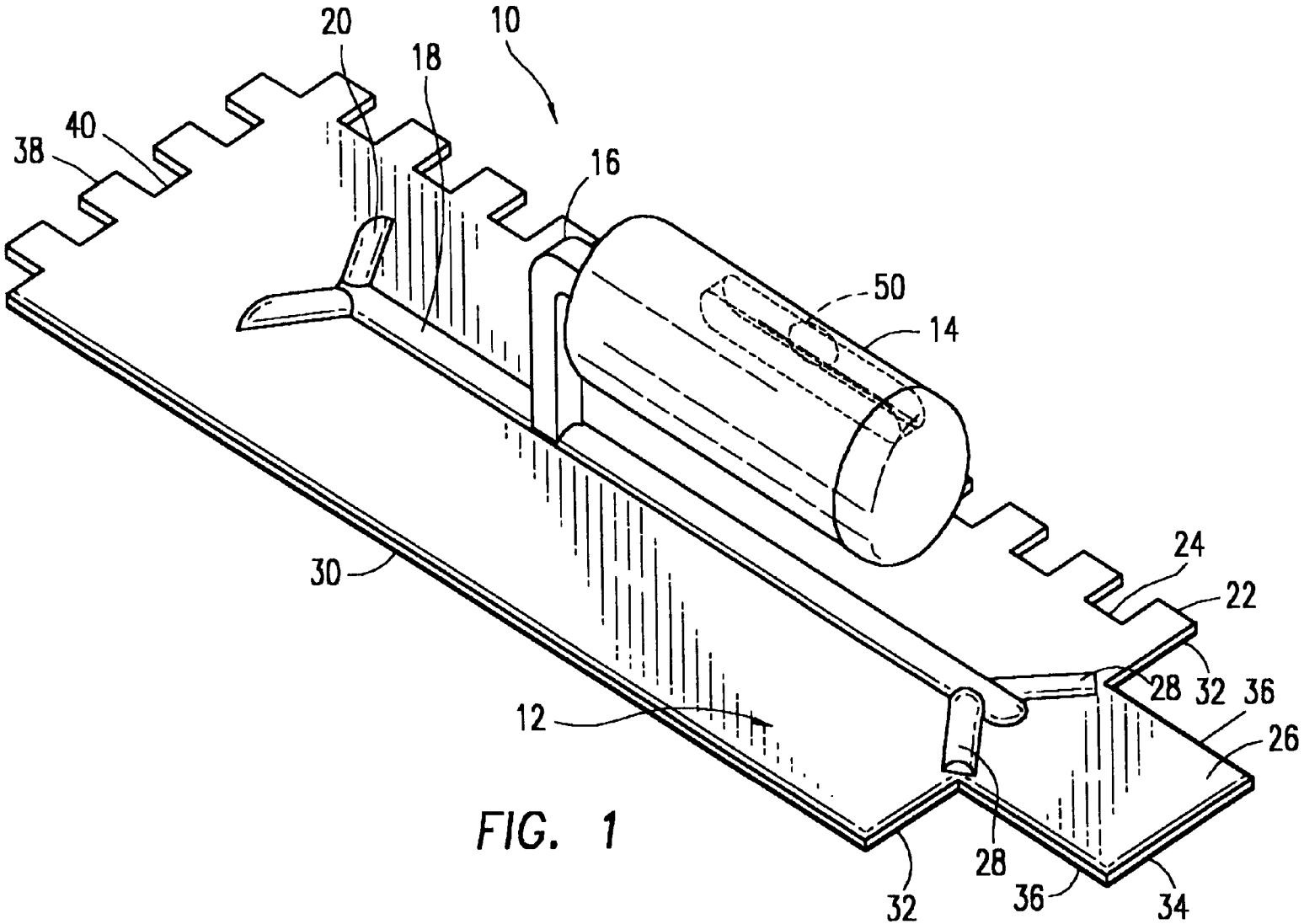
FIG. 1 shows a perspective view of a trowel in accordance with the present invention.

Referring now to FIG. 1, the present invention is shown generally at 10 comprising a rigid forged steel blade body 12 hereinafter "blade 12" that is flat, very rigid and in the embodiment shown in FIG. 1 substantially rectangular.

The blade 12 has a longitudinal edge made up of saw tooth shaped notches 22 and 24 with rectangular, or square notches 22 and 24 aligned along the right longitudinal edge (top view). At the top edge of the blade, the smaller edge, along the width of the device, has additional square notches 38 and 40. The notches 22, 24, 38 and 40 are used to apply to a surface (floor or wall) and to manipulate the cementious adhesive material to provide rows or spaces in the material for attaching ceramic tiles to a surface. The trowel notches create proper spacing for surface adhesion between the tile bottom and the cementious material and the surface the tile is being laid on, such as a floor or a wall.

The metal blade 12 is very thin but strong and also includes a longitudinal left edge 30 (top view) that is basically straight (180° angle).

A cylindrical handle 14 is used to manually grasp the tool. The handle 14 is essentially a cylindrical rigid member (wood, metal or plastic) having a hollow center portion and is attached to an L-shaped handle support member 16 that runs through the center axis of the cylindrical handle 14 and is connected directly to handle 14 so that the handle 14 cannot slide off the support member 16. Thus, the handle 14 is firmly attached to the blade 12 through support member 18 and the L-shaped support 16 which is welded to the blade 12.

In order to give additional compression strength to the thin blade 12, additional bar-shaped elongated support members 20 and 28 are welded at or near each end of support number 18 and are positioned longitudinally and laterally or at an angle there between.

The bottom end portion of the blade 12 extends outwardly from the blade central portion. The purpose of the blade end 26 is to allow the trowel to act as a margin trowel so that the lower end 26 which includes additional support from support bars 28 can be used to pry and move a tile that has been set.

The trowel further includes a liquid air bubble level mounted permanently in a slot 50 in handle 14. The level is used and is spaced on one side of the handle 14 opposite the opposing edge 30 of blade 12 so that when the trowel edge 30 is laid flush against tile upper surface, the level indicator 50 will be observable on the top portion of the handle 14. This can be accomplished with a single tool as shown in FIG. 1.

Figure 2:
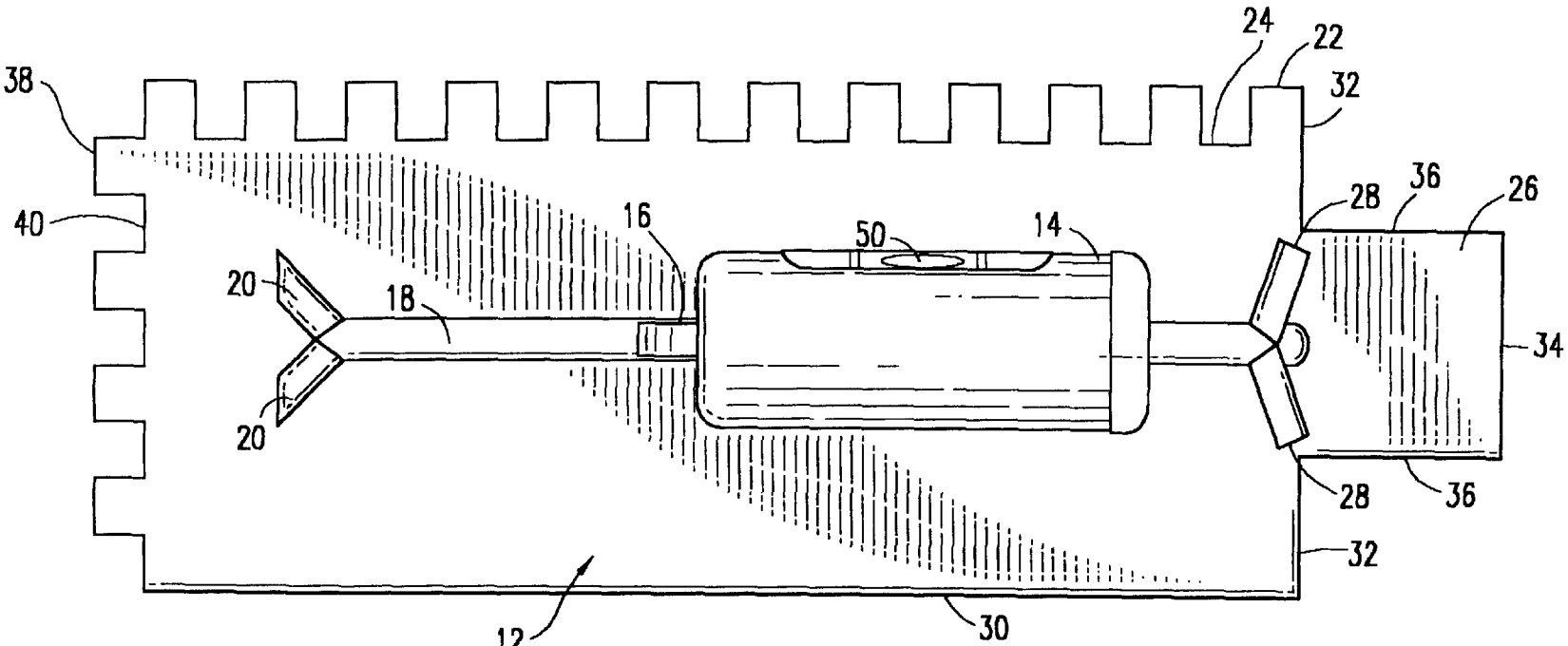
FIG. 2 shows a top plan view of a trowel in accordance with the present invention.

Referring now to FIG. 2, the trowel end 26 which functions as a margin trowel, is shown having an end edge portion 34 defined by rectangular side edges 36 which protrude well away from the end of blade 12 along edge 32 at the rear end of the trowel blade. The distance from the trowel blade 12 bottom edge 32 to the end of edge 34 is approximately 1" and preferably much greater 2 inches to 3 inches. Also note that blade edge 30 should be straight and positioned so that when edge 30 is flush against the surface of the tile, the level indicator is accurate with gravity.

Figure 3:
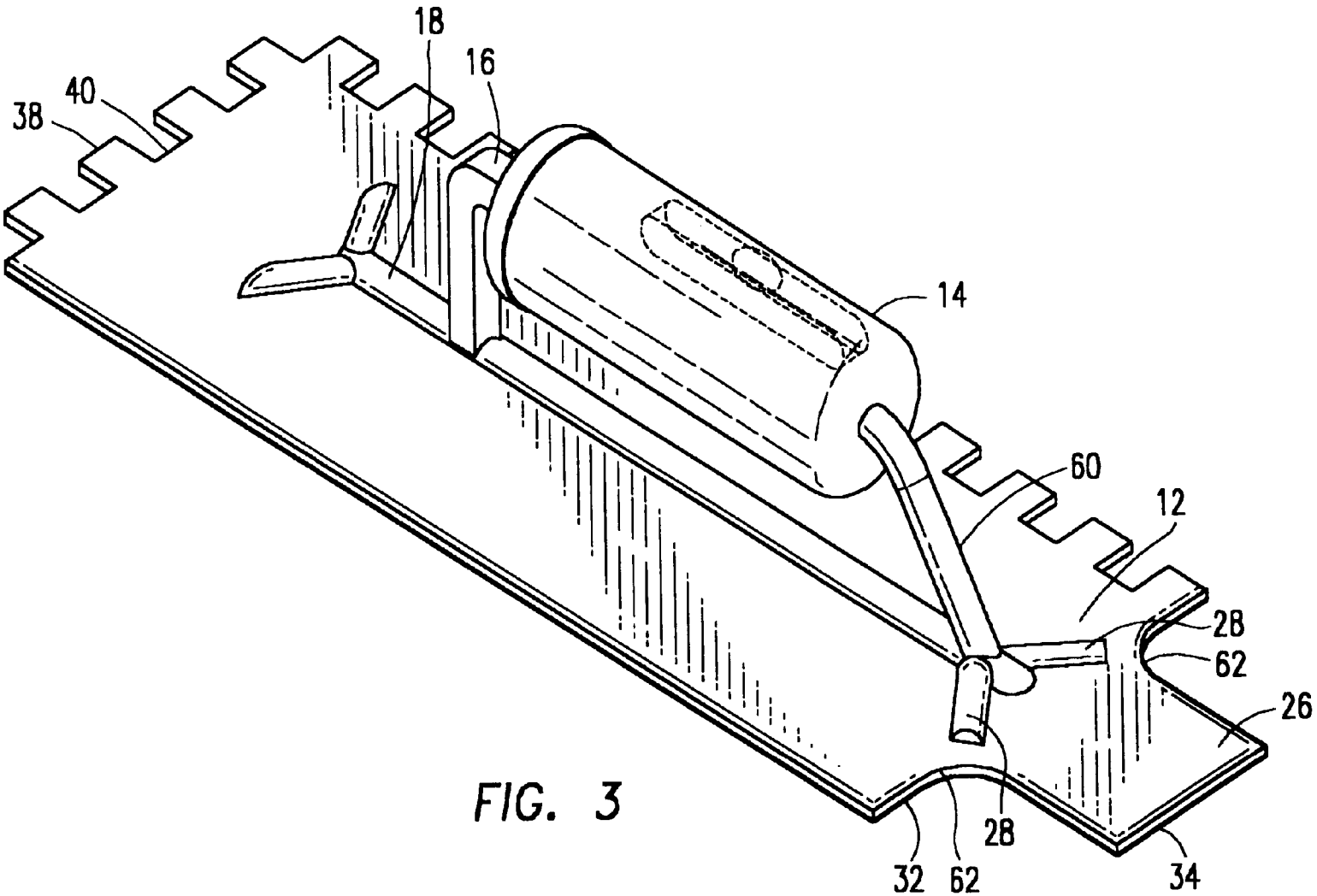
FIG. 3 shows an alternate embodiment of the present invention in perspective.

FIG. 3 shows an alternate embodiment that includes an additional rigid support arm 60 which is rigidly attached to handle 14 and to blade 12 near the structured bars 28. Again this trowel can include one longitudinal edge with a predetermined notch edge pattern and one top (width) edge with the same notch array.

Figure 4:
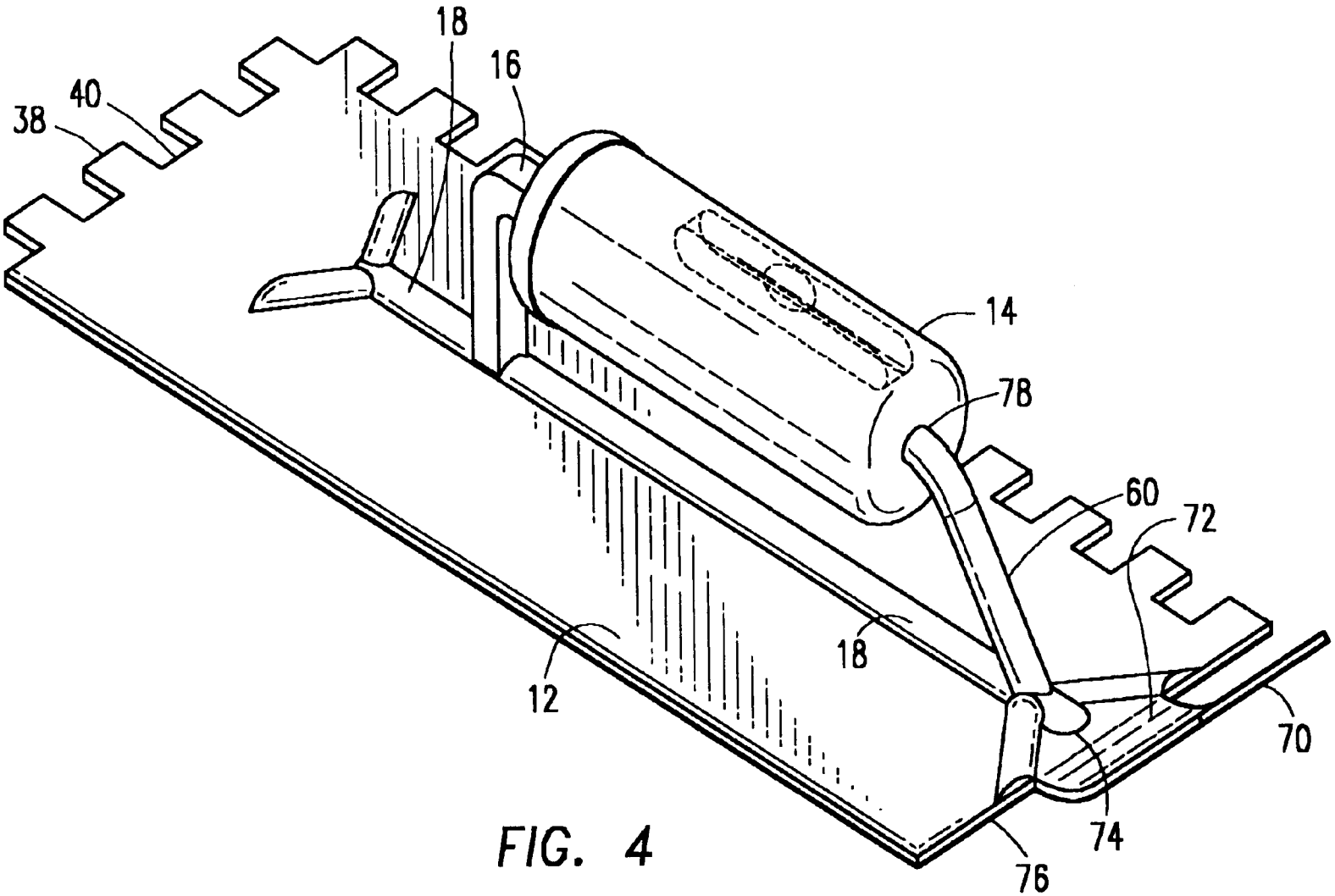
FIG. 4 shows yet another embodiment of the invention in perspective.

Referring now to FIG. 4, an alternate embodiment of the invention is shown wherein the handle 14 has a support arm 60 rigidly attached along 78 to the metal handle support inside the wooden handle at one end which is welded to a margin lever arm 72 which projects away and up at approximately an upwardly 45 degree angle from the blade 12. The margin lever arm 72 is a thin metal, very sturdy, rigid margin arm that includes in its end a trapezoidal-shaped plate 70 that can be used to pry up ceramic tile pieces. The support arm 60 is also welded to a portion of the margin arm 72 along portion 74. The arm 72 may also be welded or formed as part of blade 12, as it extends beyond the blade edge 76 away from the blade and upward to allow for positioning the arm and the end portion 70 beneath the ceramic tile. Thus, in the embodiment shown in FIG. 4, which could also include a level in the handle, the trowel blade 12 can be used as a normal trowel having rectangular notches and also as a margin trowel because of the arm 72.

Figure 5:
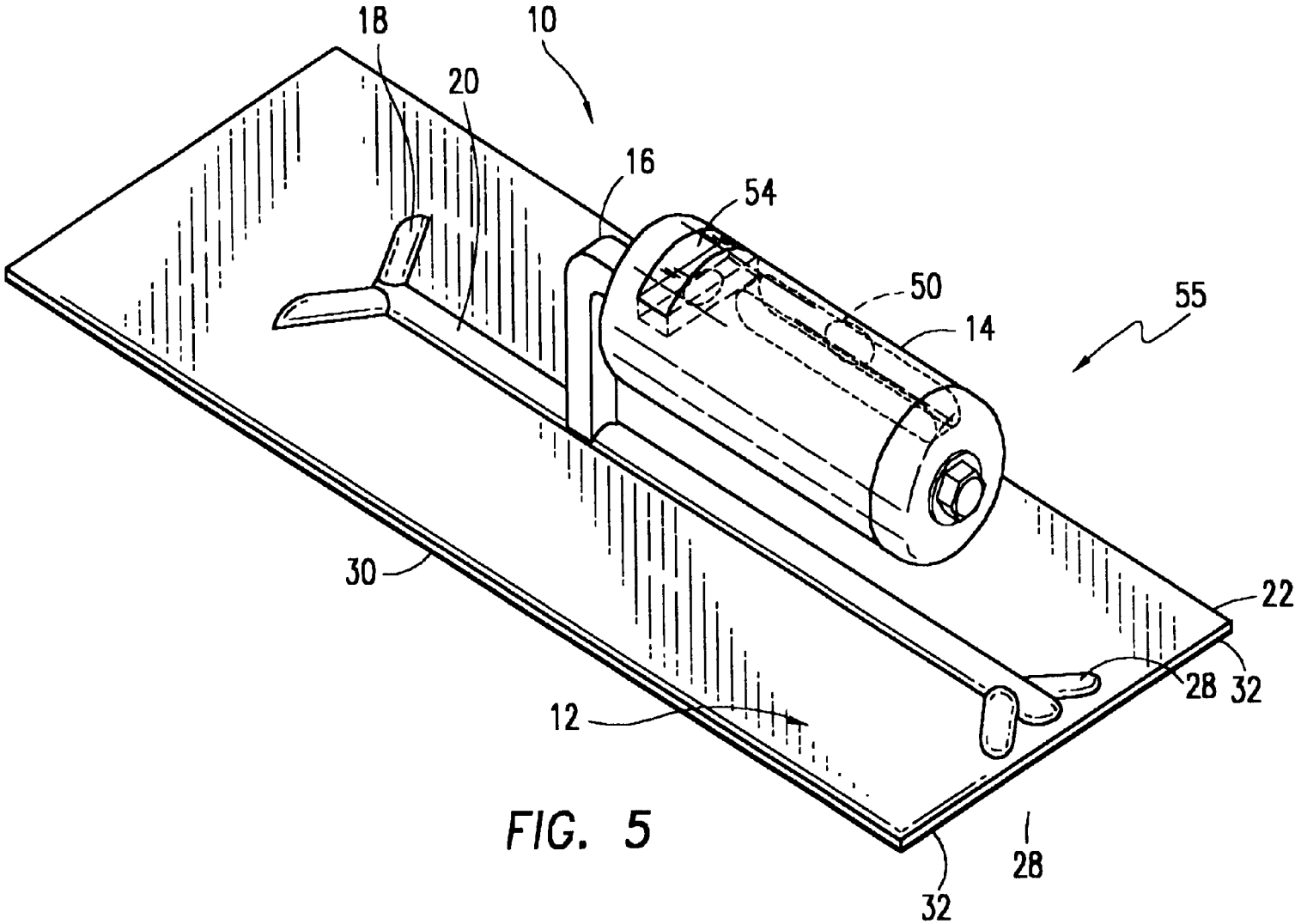
FIG. 5 shows a perspective view of an alternate embodiment of the invention showing an improved trowel having at least two level indicating components.

In yet another embodiment, the level indicator can be placed in the handle or as the body of the blade for all masonry trowels. Referring now to FIG. 5, another alternate embodiment of the invention is shown which includes a standard trowel 55 having a handle 14 that is cylindrical and having a first-level indicating component 50 imbedded on one side of the cylindrical handle 14 and being parallel to longitudinal edge 30 of trowel blade 12. Longitudinal edge 30 is placed flush and perpendicular to the earth on the top of a piece of tile. The level indicator 50, which will be substantially parallel to the earth's surface will be in a position when rotated properly when the trowel blade 12 is itself substantially perpendicular to the earth so that the level indicating device 50 can determine visually whether or not edge 30 is in fact level with the earth. However, a second level indicating device 54 is mounted in handle 14 as a chord and is perpendicular in essence and in a different plane than the first indicating level 50. The second level indicator 54 is used with the trowel blade being substantial vertical in a longitudinal direction perpendicular to the earth is in fact straight up and down relative to the earth such that the tile vertical edges are perpendicular to the earth.

Figure 6:
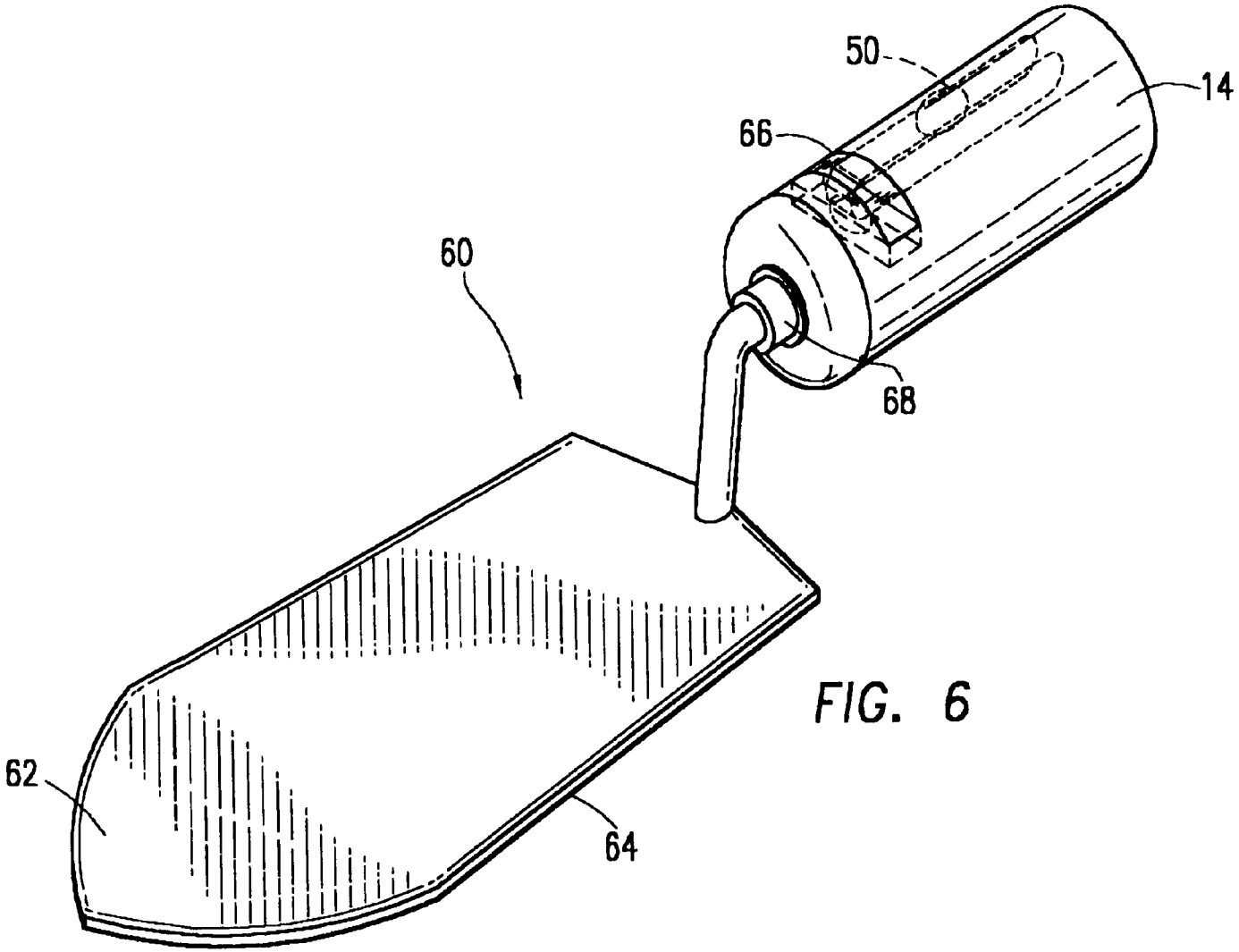
FIG. 6 shows a perspective view of yet another trowel including first and second level indicating components.

Referring now to FIG. 6, a masonry or brick layer's trowel is shown at 60 having a trowel blade 62 that is substantially triangular and comes to a point at front end, and Applicant's invention includes a straight edge portion 64 that functions in combination with a second indicating level 66 to provide for vertical alignment of bricks or tile. The trowel 60 also includes in handle 14 the first level indicator 50 that also can measure whether a tile or brick is level relative to the earth's surface in conjunction with edge 64. Element 68 acts as a stop or washer that acts to hold handle 14 in place in conjunction with a bolt (not shown in FIG. 6 at the opposite end).

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hand-held trowel for setting and laying ceramic tile for manipulating cementious material and for prying up ceramic tiles comprising:

a rigid, thin body, said body having at least one edge that has a plurality of notches disposed therein, said notches used for separating and spreading cementious material, said body having a second edge sized for prying a ceramic tile, said second edge having a portion extending away from said thin body;

a handle for grasping, rigidly attached to one side of said thin, rigid body.

2. A device as in claim 1, including a gravitationally level indicating element connected to said handle and aligned with a flat edge of said device, said device having at least one flat edge and said level indicating device being aligned so that when said edge is placed on a tile surface, said level indicating means can tell whether gravitationally said tile is level.

3. A device as in claim 1, including:

a first-level indicating means and a second level indicating means; said first and second level indicating means attached to said handle and substantially perpendicular to each other providing two different level indications using said trowel.

* * * * *